US006187105B1

(12) United States Patent
Matlschweiger

(10) Patent No.: US 6,187,105 B1
(45) Date of Patent: Feb. 13, 2001

(54) METHOD OF REMOVING DEPOSITS FROM A CONDUIT WALL

(76) Inventor: Peter Matlschweiger, Trefflingerstrasse 5, A-4650 Lambach (AT)

( * ) Notice: Under 35 U.S.C. 154(b), the term of this patent shall be extended for 0 days.

(21) Appl. No.: 09/403,219

(22) PCT Filed: Apr. 15, 1998

(86) PCT No.: PCT/AT98/00094

§ 371 Date: Oct. 29, 1999

§ 102(e) Date: Oct. 29, 1999

(87) PCT Pub. No.: WO98/46374

PCT Pub. Date: Oct. 22, 1998

(30) Foreign Application Priority Data

Apr. 16, 1997 (AT) ..... 653/97

(51) Int. Cl.[7] ..... B08B 9/04

(52) U.S. Cl. ..... 134/8; 134/6; 134/22.1; 134/22.11; 134/22.12; 134/22.18; 134/34; 134/42; 15/104.09; 15/104.31; 15/104.095

(58) Field of Search ..... 15/104.09, 104.095, 15/104.31; 134/6, 8, 22.1, 22.11, 22.12, 22.18, 34, 42

(56) References Cited

U.S. PATENT DOCUMENTS

| | | | | |
|---|---|---|---|---|
| 2,074,213 | | 3/1937 | Deem . | |
| 4,715,747 | * | 12/1987 | Behrens | 434/22.11 |
| 4,795,495 | * | 1/1989 | Dobson, Sr. | 134/22.11 |
| 5,090,079 | * | 2/1992 | Allison et al. | 15/104.09 |
| 5,580,393 | * | 12/1996 | Lawther | 15/104.31 |
| 5,899,795 | * | 4/1999 | Penza | 15/104.09 |
| 5,911,255 | * | 6/1999 | Bond | 134/22.11 |
| 5,953,782 | * | 9/1999 | Vogel et al. | 15/104.09 |
| 5,988,188 | * | 11/1999 | Born | 134/22.12 |

FOREIGN PATENT DOCUMENTS

| | | |
|---|---|---|
| 0 397 777 | 6/1994 | (AT) . |
| 34 27 371 | 2/1986 | (DE) . |
| 44 16 721 | 1/1997 | (DE) . |
| 195 30 880 | 2/1997 | (DE) . |
| 0 391 046 | 2/1990 | (EP) . |
| 1565474 | 5/1969 | (FR) . |
| 6804149 | 9/1969 | (NO) . |

* cited by examiner

*Primary Examiner*—Sharidan Carrillo
(74) *Attorney, Agent, or Firm*—Collard & Roe, P.C.

(57) ABSTRACT

A method of cleaning a conduit including a downpipe by removing deposits from a removal area in the downpipe, comprising the steps of introducing a milling cutter into the conduit below the removal area and rotatingly driving the milling cutter by a flexible shaft, feeding the rotating milling cutter through the conduit including the removal area in the downpipe by drawing the milling cutter in an upward direction above the removal area, removing the deposits with the rotating milling cutter, permitting flushing water to flow into the conduit from above the removal area for carrying away the removed deposits, and injecting flushing water into the conduit under pressure below the removal area in an outflow direction.

1 Claim, 2 Drawing Sheets

METHOD OF REMOVING DEPOSITS FROM A CONDUIT WALL

BACKGROUND OF THE INVENTION

1. Field of the Invention

Figure 1:
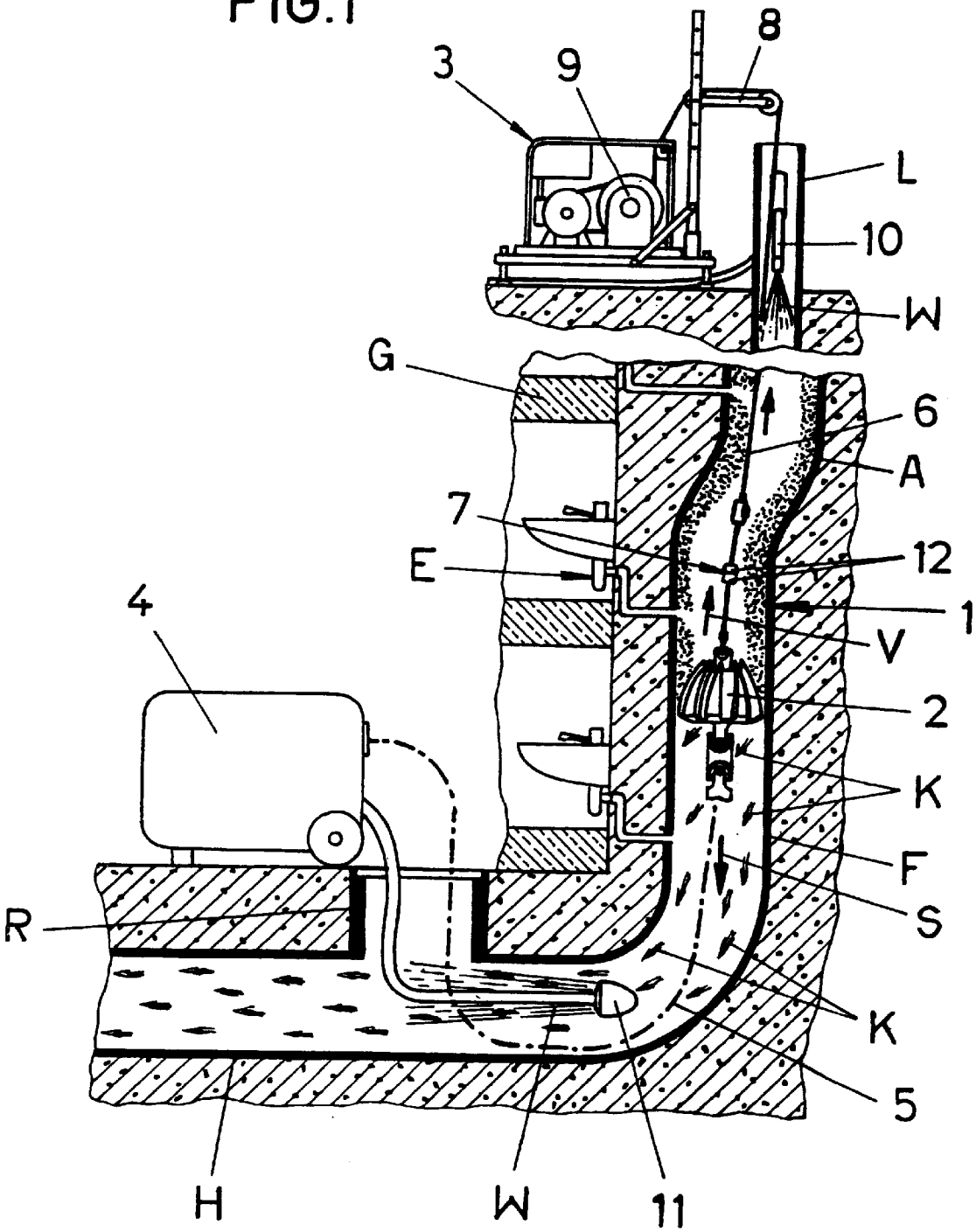

This invention relates to a method of cleaning a conduit including downpipe, by which a cleaning tool to be rotatingly driven via a flexible shaft, in particular a helical spring, is subjected to a longitudinal feed extending in conduit direction for removing deposits in the pipe, while at the same time flushing water is allowed to flow into the conduit for carrying away the cuttings above the removal area, and below the removal area flushing water is injected into the conduit in outflow direction with excess pressure.

2. Description of the Prior Art

Conduits, in particular sewer and drain pipes, are more and more constricted in their inside flow cross-section due to soiling and encrustation, until the amounts of water produced can no longer flow off and there is a backpressure and as a result thereof damages caused by water. In order to remedy this problem and prevent the conduit from clogging or to clear a clogged pipe, there already exist cleaning methods where the deposits are worked off mechanically and swept away. For this purpose, a chain centrifuge serving as cleaning tool and rotating via a drivable helical spring is introduced from the top into a downpipe of a conduit to be cleaned, where the chain parts of the chain centrifuge strike against the deposits and work off the deposits on the wall. However, these chain centrifuge tools can hardly be metered in their effect, the conduits are subjected to a considerable, often already damaging impact load, and the tool advanced substantially due to gravity is hardly able to overcome curvatures of the conduit, as they frequently occur for instance as gravity brakes in higher downpipes or in the case of mutually offset pipe sections. In addition, due to the impact effect of the chain centrifuge relatively coarse pieces and plate-shaped parts of the hard deposits are detached and blasted off, which fall downwards and/or are swept along with the flushing water and advance into the yet uncleaned, constricted pipe, where cloggings caused by the cuttings are then virtually inevitable. The newly introduced water or waste water flowing into the downpipe can no longer flow off, and there is a risk of backpressure along with the great consequential damages. The known cleaning methods therefore remain unsatisfactory and can only be used successfully in simple cases because of the involved risk of a damage exceeding the benefits.

Moreover, there already exist all kinds of cleaning methods for cleaning horizontal conduits, which methods employ milling cutters such as rotary water milling cutters (DE 44 16 721 C), root milling heads (DE 34 27 371 A) or the like, which are drawn in feed direction or advanced via an ejection of pressurized water, which methods are, however, not suited for cleaning strongly encrusted downpipes. Furthermore, there are known methods for expanding the inside cross-section of a chimney (DE 195 30 880 A), where milling heads with stepped diameters are introduced into the chimney from the top, which methods cannot be used for cleaning downpipes of a conduit, as pipe curvatures cannot be taken into account and the risk of clogging by the detached cuttings would be too great.

SUMMARY OF INVENTION

It is therefore the object underlying the invention to eliminate these deficiencies and provide a method as described above, which ensures an economic and reliable cleaning of all kinds of conduits without a risk of clogging or backpressure. Moreover, there should be created an expedient apparatus for carrying out this method.

This object is solved by the invention in that the deposits in the pipe are removed in a manner known per se by a milling operation with a longitudinal feed opposite to the outflow direction, for which purpose the milling cutter used as cleaning tool and introduced into the conduit below the downpipe is drawn from the front side in feed direction and rotatingly driven from the rear side in feed direction. Due to the cleaning operation advanced in upstream direction, the soilings and deposits removed can be discharged in downstream direction through the pipe already cleaned, and there will be no constriction of the pipe cross-section providing a risk of clogging along the conveying path. The flushing water flowing off from the top carries along the cuttings in flow direction, and the pressurized water injected in downstream direction below the tool accelerates and completes this discharge. Moreover, the deposits and soilings are worked off by the milling operation not in large parts, but in relatively small pieces, which substantially facilitates the removal and ensures a neat and complete discharge of the material by means of the flushing water. Drawing the milling cutter along with the correspondingly adjustable driving speed furthermore allows to specifically adapt the milling operation to the respective conditions, so that a proper and efficient cleaning is obtained. The cable-operated longitudinal feed of the milling cutter can likewise sensitively be adjusted to the respective course of the conduit, so that pipe curvatures and other changes in the direction of the conduit can easily be handled without impeding the milling cleaning. Depending on the local conditions and the degree of soiling and deposition, the cleaning operation is performed in several steps by means of milling cutters having stepwise increased diameters, and there can always be ensured a mode of operation careful both with respect to the pipe and with respect to the tool.

For performing the method various means and apparatuses known per se may be used, which in addition to supplying and discharging the flushing water provide for the drive of the flexible shaft for the tool drive and a traction cable with cable winch for the longitudinal feed of the cleaning tool. It is particularly advantageous when as cleaning tool there is provided a milling head known per se, which is rotationally symmetrical with respect to the drive axle due to the shaft connection and on its rear end face has the shaft connection and on its front end face has an attachment lug, where the milling head comprises a body of rotation as milling body with a generatrix sloping towards the attachment lug in an arc-shaped manner, from which milling body cutter parts preferably extending along helical lines and forming cutting edges protrude on the side of the shell. This milling head can quickly be connected at one end to the traction cable producing the longitudinal feed and at the other end to a helical spring or another flexible shaft for the rotary drive, and due to its convex basic shape allows to work off deposits of various thicknesses during the longitudinal feed, which convex basic shape in addition provides for properly working off the deposits in the vicinity of pipe curvatures or the like. In addition to the required high removal effect, the cutting edges extending at an angle, preferably helically with respect to the axis of rotation also involve a removal effect for the material worked off, which together with the flushing water ensures a proper, easy discharge of the cuttings. The milling body itself can be produced economically and provides a particularly resistant milling cutter of high cutting efficiency with a long service life.

Since the milling cutter undergoes a rotary movement during the longitudinal feed, and the traction cable producing the longitudinal feed should remain untwisted to prevent twist and untwist phenomena, the milling head can advantageously be attached to a traction cable by means of an associated rotary coupling to be connected on the one hand to the attachment lug of the milling head and on the other hand to the traction cable, which rotary coupling has coupling members supported so as to be rotated relative to each other about an axis of rotation extending in pull direction. These coupling members rotatable with respect to each other prevent the transmission of the rotary movement of the milling head to the traction cable and provide for a proper traction haulage of the rotating milling head.

BRIEF OF THE DRAWINGS

Figure 2:
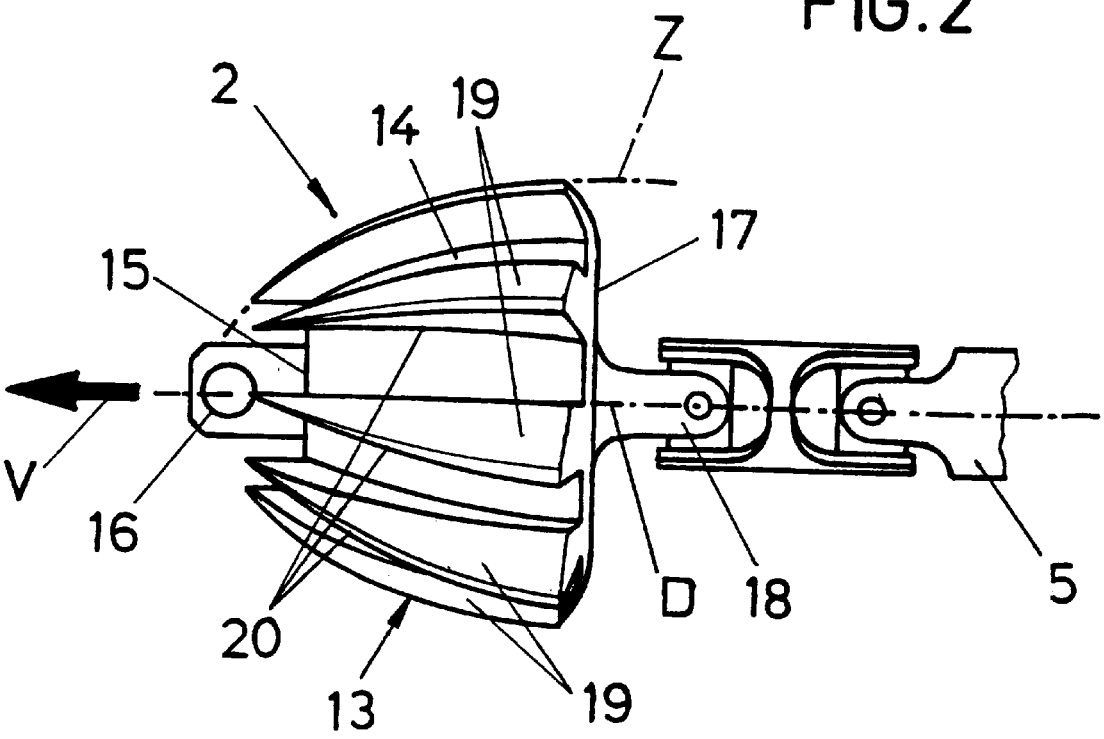
Figure 3:
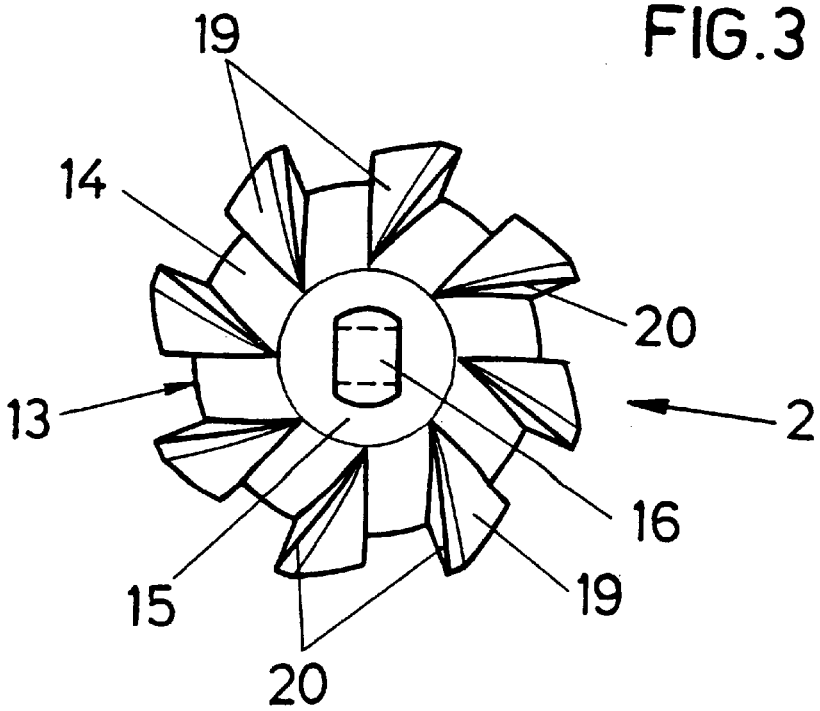

In the drawing, the subject-matter of the invention is represented by way of example, wherein:

FIG. 1 schematically illustrates the cleaning of a conduit by the method in accordance with the invention, and FIGS. 2 and 3 represent a cleaning tool for performing this method in a side view and in a front view, respectively.

DESCRIPTION OF THE PREFERRED EMBODIMENT

The sewage disposal system E of a building G has a conduit 1 including a downpipe F which at its upper end opens into an air shaft L and at its lower end verges into a horizontal pipe H. To be able to clean such conduit 1 effectively and without a risk of backpressure and damage, the pipe deposits A are worked off by a milling operation with a longitudinal feed V directed from the bottom to the top, where a milling cutter 2 serving as cleaning tool is drawn in feed direction by means of a cable pull device 3 and from the rear side in feed direction is rotatingly driven via a drive means 4 by means of a helical spring 5.

For this purpose, the conduit 1 is opened at the top in the vicinity of the air shaft L and at the bottom in the vicinity of an inspection shaft R of the horizontal pipe H and the pipe length to be cleaned is made accessible. In a manner not represented in detail, a helical spring is then introduced from the top via a drive unit mounted at the roof through the air shaft L into the conduit 1 and rotatingly advanced up to the area of the inspection shaft R, whereupon the upper end of the helical spring is uncoupled from the drive unit and connected with the traction cable 6 of the cable pull device 3, so that the traction cable can be drawn in with the helical spring from the top to the bottom through the conduit 1 up to the inspection shaft R. Now, the actual cleaning operation can be started:

The helical spring 5 is coupled to the drive means 4, which ensures a speed-controlled milling drive, and is fitted with the milling cutter 2, which in turn is attached to the traction cable 6 by inserting a rotary coupling 7. The traction cable 6 is guided via a correspondingly adjustable boom 8 of the cable pull device 3 and can be drawn in by means of an associated motor winch 9 at a controllable drawing speed. Along with the winding up of the traction cable 6, which ensures the longitudinal feed V of the milling cutter 2 along the conduit 1, the milling cutter 2 is rotated via the drive means 4 and the helical spring 5, so that a milling cleaning is obtained. In addition, flushing water W is allowed to flow in from the top via an upper water supply line 10 into the conduit 1, and at the bottom behind the milling cutter 2 a nozzle body 11 introduced into the horizontal pipe H is pressurized by means of a pump unit incorporated in the drive means 4, and in outflow direction S flushing water W is injected into the conduit 1, in order to be able to discharge the cuttings.

On its path through the conduit 1, which extends opposite to the outflow direction S, the milling cutter 2 mills off the deposits A in small pieces, which cuttings K are immediately flushed away in the direction of the pipe already cleaned, so that there is no risk of clogging and disorder. The rotary coupling 7 between milling cutter 2 and traction cable 6, which has two coupling members 12 rotatable with respect to each other, prevents a transmission of the rotary movement from the milling cutter 2 to the traction cable 6, which prevents the cable from untwisting. By means of correspondingly metered rotational speeds of the milling cutter 2 on the one hand, and on the other hand by feed rates adjusted to these rotational speeds, which feed rates can be adjusted by the traction movement of the motor winch 9, the milling operations can optimally be adapted to the respective deposits A and changes in the direction of the conduit 1, which ensures an efficient cleaning.

As is indicated in FIGS. 2 and 3, a milling head 13 with a milling body 14 of substantially convex shape in direction of the longitudinal feed V is provided as milling cutter 2, where at the front end face 15 in feed direction there is disposed an attachment lug 16 for attachment of the traction cable 6 and/or the rotary coupling 7 and on the rear end face 17 there is disposed a shaft connection 18 for coupling thereto a helical spring 5. The milling body 14 includes a body of rotation with a generatrix Z sloping towards the attachment lug 16 in an arc-shaped manner, which generatrix rotates about the drive axle D through the attachment lug 16 and the shaft connection 18, from which body of rotation cutter parts 19 protrude on the side of the shell, which form cutting edges 20 extending along helical lines. By means of this milling head 13 the deposits A inside the conduit 1 are efficiently milled off in small pieces, where due to its forwardly directed convex shape the milling head easily works off deposits of different thicknesses and can follow changes in the direction of the conduit 1 without impairing the milling operation.

The inventive cleaning method, which involves working off the pipe deposits by a milling operation extending opposite to the outflow direction, ensures an economic cleaning of all kinds of conduits, which is careful with respect to pipes and tools and can optimally be adapted to the respective conditions.

What is claimed is:

1. A method of cleaning a conduit including a downpipe by removing deposits from a removal area in the downpipe, comprising the steps of (a) introducing a milling cutter into the conduit below the removal area and rotatingly driving the milling cutter by a flexible shaft, (b) feeding the rotating milling cutter through the conduit including the removal area in the downpipe by drawing the milling cutter in an upward direction above the removal area, (c) removing the deposits with the rotating milling cutter, (d) permitting flushing water to flow into the conduit from above the removal area for carrying away the removed deposits, and (e) injecting flushing water into the conduit under pressure below the removal area in an outflow direction.

* * * * *